US007222761B1

(12) United States Patent
Licwinko

(10) Patent No.: US 7,222,761 B1
(45) Date of Patent: May 29, 2007

(54) HANGER APPARATUS

(76) Inventor: Andrea Licwinko, 26 Rosemont Ave., Norristown, PA (US) 19401

( * ) Notice: Subject to any disclaimer, the term of this patent is extended or adjusted under 35 U.S.C. 154(b) by 441 days.

(21) Appl. No.: 10/782,100

(22) Filed: Feb. 19, 2004

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 5,102,019 | A | 4/1992 | Lam | |
| 5,476,199 | A * | 12/1995 | Halverson et al. | 223/94 |
| 5,511,701 | A * | 4/1996 | Lam | 223/85 |
| 5,613,627 | A * | 3/1997 | Marks | 223/85 |
| 5,941,429 | A * | 8/1999 | Koons | 223/94 |
| 6,179,174 | B1 | 1/2001 | Kandl | |
| 6,409,058 | B1 | 6/2002 | Lam et al. | |
| 6,644,520 | B2 * | 11/2003 | Lam | 223/94 |
| 6,688,503 | B2 * | 2/2004 | Viazanko et al. | 223/89 |
| 2002/0079340 | A1 * | 6/2002 | Kolstad | 223/85 |
| 2005/0011917 | A1 * | 1/2005 | Tubman et al. | 223/85 |
| 2005/0092787 | A1 * | 5/2005 | Stokes | 223/94 |
| 2005/0224530 | A1 * | 10/2005 | Schaller | 223/85 |

* cited by examiner

*Primary Examiner*—Shaun R. Hurley

(57) ABSTRACT

A hanger apparatus for allowing garments of various sizes to be hung up with out being stretched. The hanger apparatus includes a hook member being designed for selectively engaging a hanging member whereby the hook member is suspended from the hanging member. A pair of arm members are coupled to the hook member whereby the arm members are suspended from the hanging member when the hook member engages the hanging member. The arm members are designed for being positioned in one of the garments to allow the garment to be suspended from the hanging member. Each of a pair of extension assemblies engages one of the arm members whereby each of the extension assemblies selectively extends beyond the associated one of the arm members to accommodate garments of a larger size.

4 Claims, 4 Drawing Sheets

HANGER APPARATUS

BACKGROUND OF THE INVENTION

1. Field of the Invention

The present invention relates to adjustable clothes hangers and more particularly pertains to a new hanger apparatus for allowing garments of various sizes to be hung up with out being stretched.

2. Description of the Prior Art

The use of adjustable clothes hangers is known in the prior art. U.S. Pat. No. 5,102,019 describes a device for extending the shoulder pads outwardly from the support arms to support garments to be hung on the hanger. Another type of adjustable clothes hanger is U.S. Pat. No. 6,409,058 having a pair of movable arms that are extendable from a medial portion to accommodate garments of different sizes. U.S. Pat. No. 6,179,174 has a pair of V-shaped connectors that are connected to a V-shaped hanging member with the connectors being adjustable with respect to hanging member to accommodate garments of different sizes.

While these devices fulfill their respective, particular objectives and requirements, the need remains for a device that has certain improved features to provide stability in the hanger when larger garments are placed on the hanger.

SUMMARY OF THE INVENTION

The present invention meets the needs presented above by providing extension assemblies that are operationally coupled to the arm members and are not part of the arm members thereby allowing the arm members to maintain the strength of the arm members.

Still yet another object of the present invention is to provide a new hanger apparatus that has enlarged extension members to spread the weight of the garment over a greater area to inhibit the garment being stretched by the extension members.

To this end, the present invention generally comprises a hook member being designed for selectively engaging a hanging member whereby the hook member is suspended from the hanging member. A pair of arm members are coupled to the hook member whereby the arm members are suspended from the hanging member when the hook member engages the hanging member. The arm members are designed for being positioned in one of the garments to allow the garment to be suspended from the hanging member. Each of a pair of extension assemblies engages one of the arm members whereby each of the extension assemblies selectively extends beyond the associated one of the arm members to accommodate garments of a larger size.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
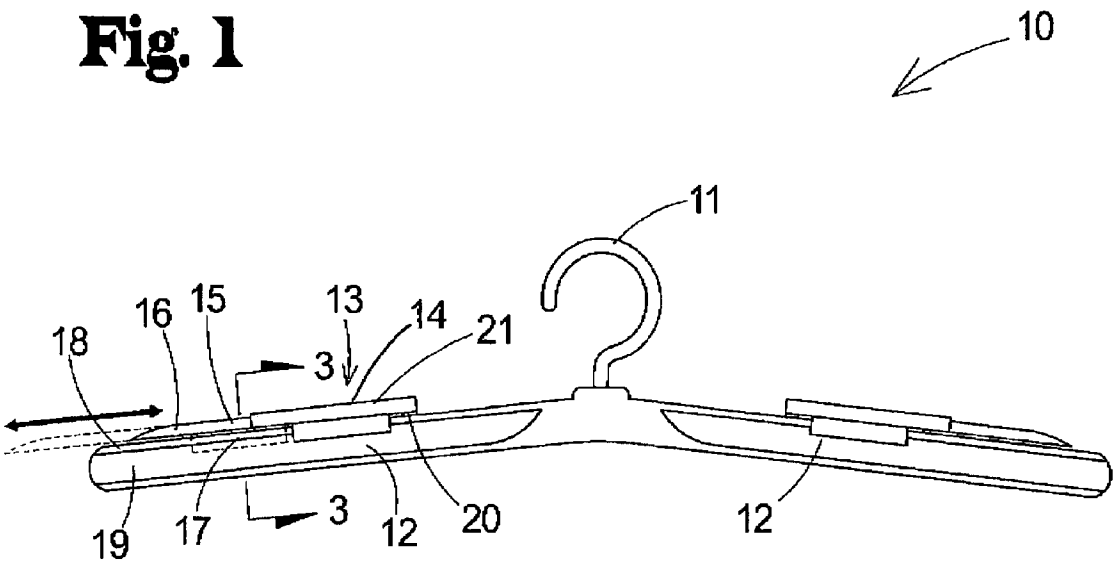
FIG. 1 is a front view of a new hanger apparatus according to the present invention.
Figure 2:
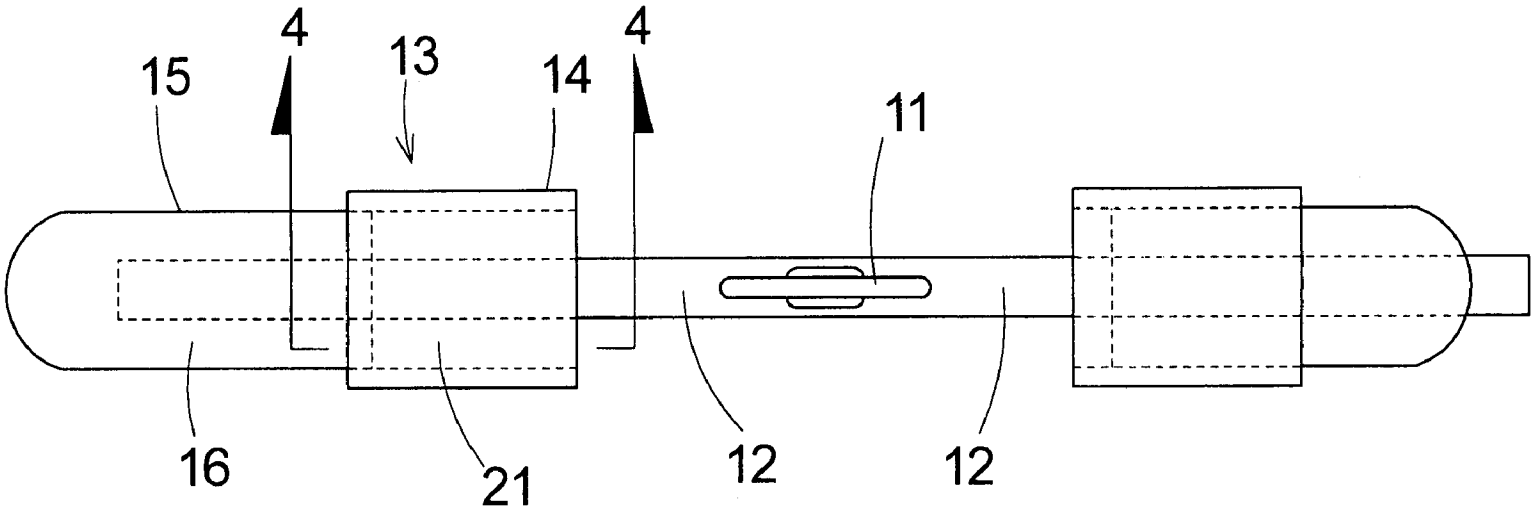
FIG. 2 is a top view of the present invention.
Figure 3:
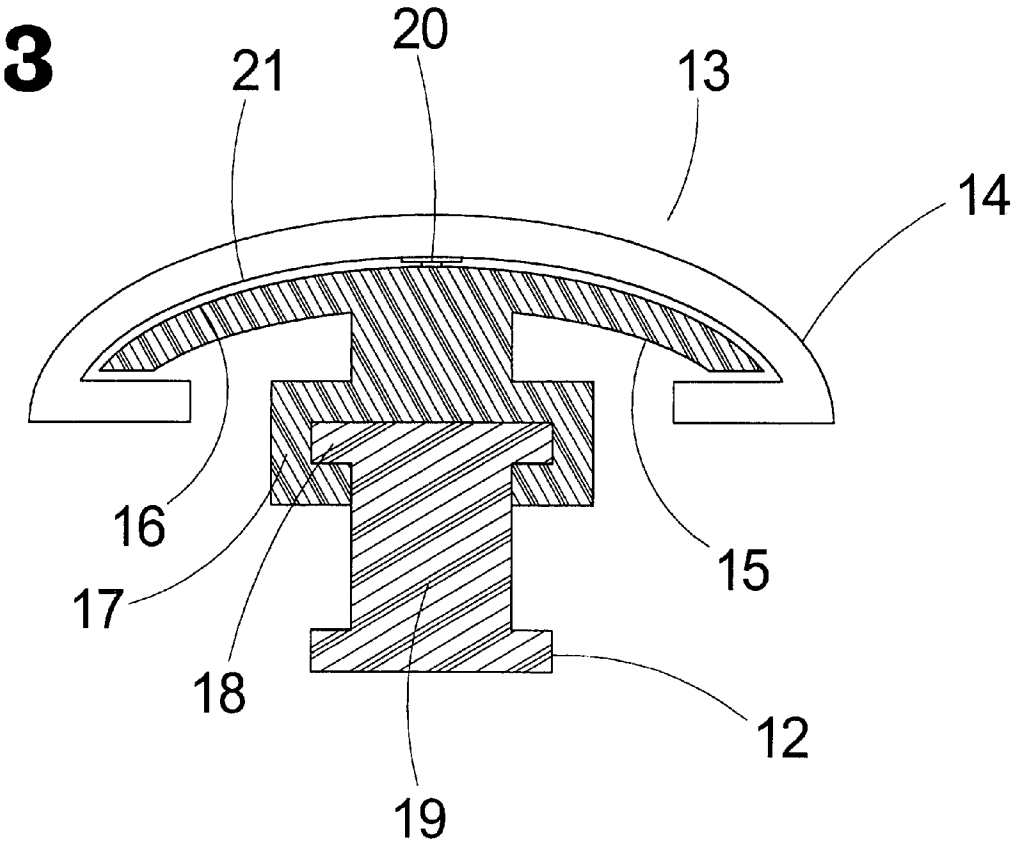
FIG. 3 is a cross-sectional view of the present invention taken along line 3—3 of FIG. 1.
Figure 4:
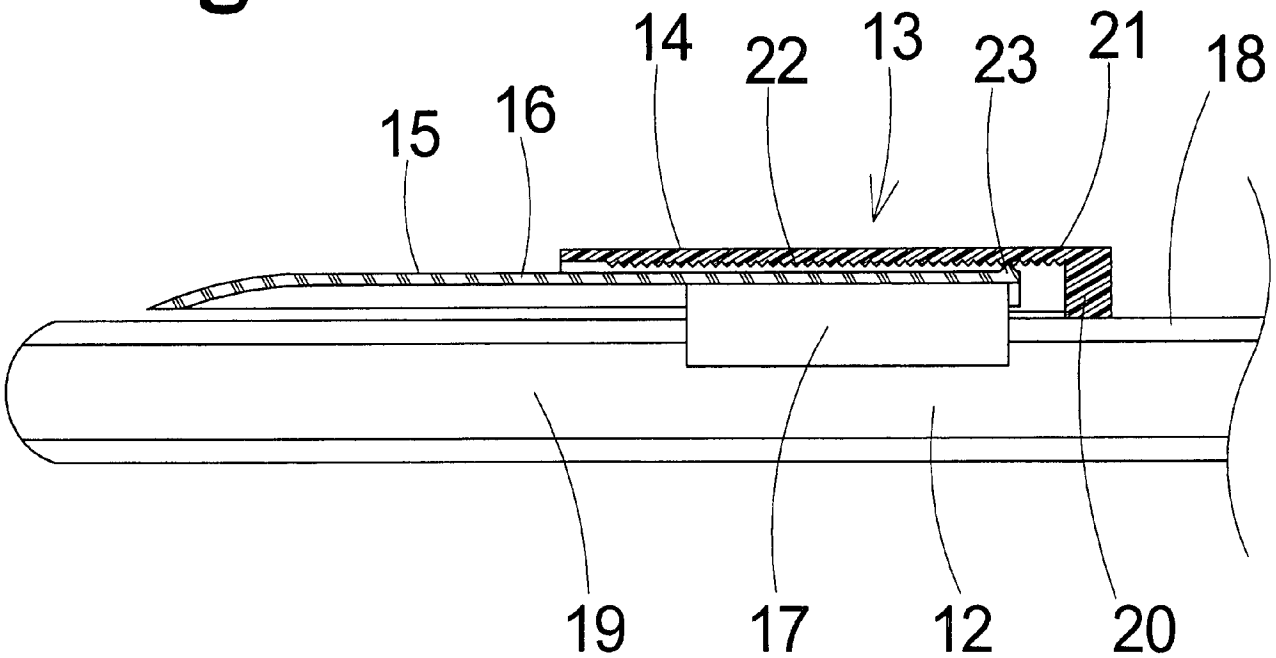
FIG. 4 is a cross-sectional view of the present invention taken along line 4—4 of FIG. 2.

With reference now to the drawings, and in particular to FIGS. 1 through 4 thereof, a new hanger apparatus embodying the principles and concepts of the present invention and generally designated by the reference numeral 10 will be described.

As best illustrated in FIGS. 1 through 4, the hanger apparatus 10 generally comprises a hook member 11 being designed for selectively engaging a hanging member whereby the hook member 11 is suspended from the hanging member.

A pair of arm members 12 are coupled to the hook member 11 whereby the arm members 12 are suspended from the hanging member when the hook member 11 engages the hanging member. The arm members 12 are designed for being positioned in one of the garments to allow the garment to be suspended from the hanging member.

Each of a pair of extension assemblies 13 engage one of the arm members 12 whereby each of the extension assemblies 13 selectively extends beyond the associated one of the arm members 12 to accommodate garments of a larger size.

Each of the extension assemblies 13 comprises a base member 14 and an extension member 15. The base member 14 is coupled to the associated one of the arm members 12. The extension member 15 operationally engages the base member 14 and the associated one of the arm members 12 whereby the extension member 15 is selectively positioned along a length of the associated one of the arm members 12 whereby the extension member 15 is designed for supporting garments of a larger size.

The extension member 15 of each of the extension assemblies 13 comprises a support portion 16 and a guide portion 17 the support portion 16 is coupled to the guide portion 17 whereby the support portion 16 extends upwardly from the guide portion 17. The guide portion 17 slidably engages the associated one of the arm members 12 whereby the guide portion 17 is selectively slid along a length of the associated one of the arm members 12 to allow adjustment of the extension member 15 to accommodate one of the garments. The support portion 16 is designed for supporting one of the garments when the arm members 12 are positioned in one of the garments.

Each of the arm members 12 comprises an upper portion 18 and a lower portion 19. The upper portion 18 is coupled to the lower portion 19 whereby the upper portion 18 extends outwardly from the lower portion 19. The guide portion 17 of the extension member 15 extends around the upper portion 18 of the associated one of the arm members 12 to inhibit the extension member 15 from inadvertently disengaging the associated one of the arm members 12 when the extension member 15 is slid along the associated one of the arm members 12.

The base member 14 of each of the extension assemblies 13 comprises a stanchion portion 20 and a receiver portion 21. The stanchion portion 20 is coupled to the associated one of the arm members 12. The receiver portion 21 is coupled to the stanchion portion 20 whereby the receiver portion 21 is positioned opposite the associated one of the arm members 12. The receiver portion 21 slidably receives the support portion 16 of the extension member 15 of the associated one of the extension assemblies 13. The receiver portion 21 is for maintaining alignment of the extension member 15 with the associated one of the arm members 12 when the extension member 15 is slid along the associated one of the arm members 12.

The base member 14 of each of the extension assemblies 13 comprises a plurality of teeth 22. The teeth 22 are coupled to the receiver portion 21. The extension member 15 of each of the extension assemblies 13 comprises at least one pawl 23. The pawl 23 of the extension member 15 is selectively positioned between the teeth 22 of the base member 14 of the associated one of the extension assemblies 13 to inhibit inadvertent sliding of the extension member 15 with respect to the base portion of the associated one of the extension assemblies 13.

In use, the user grips the extension member 15 of the extension assemblies 13 and slides them with respect to the associated one of the arm members 12 to match the shoulder width of the garment to be hung up. The user then slides the arm members 12 into the garment to be hung up so that the extension member 15 of each of the extension assemblies 13 in positioned under the shoulder of the garment being hung up. The hook member 11 is then engaged to the hanging member, such as a closet rod, to allow the garment member to hang from the arm members 12 and the extension assemblies 13.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hanger apparatus for adjusting to accommodate garments of different sizes, the hanger apparatus comprising:

a hook member being adapted for selectively engaging a hanging member such that said hook member is suspended from the hanging member;

a pair of arm members being coupled to said hook member such that said arm members are suspended from the hanging member when said hook member engages the hanging member, said arm members being adapted for being positioned in one of the garments to allow the garment to be suspended from the hanging member; and each of a pair of extension assemblies engaging one of said arm members such that each of said extension assemblies selectively extends beyond the associated one of said arm members to accommodate garments of a larger size;

wherein a first one of said pair of extension assemblies is adjustable on said pair of arm members independently of a second one of said pair of extension assemblies;

each of said extension assemblies comprising a base member and an extension member, said base member being mounted on the associated one of said arm members, said extension member being movable with respect to said base member and being slidable on the associated one of said arm members such that said extension member is selectively positionable along a length of the associated one of said arm members for supporting garments of a larger size;

said extension member of each of said extension assemblies comprising a support portion and a guide portion, said support portion being coupled to said guide portion such that said support portion extends upwardly from said guide portion, said guide portion slidably engaging the associated one of said arm members such that said guide portion is selectively slidable along a length of the associated one of said arm members to allow adjustment of the extension member to accommodate garments;

said base member of each of said extension assemblies comprising a stanchion portion and a receiver portion, said stanchion portion being coupled to the associated one of said arm members, said receiver portion being coupled to said stanchion portion such that said receiver portion is positioned opposite the associated one of said arm members, said receiver portion slidably receiving said support portion of said extension member of the associated one of said extension assemblies, said receiver portion being for maintaining alignment of said extension member with the associated one of said arm members when said extension member is slid along the associated one of said arm members;

said base member of each of said extension assemblies comprising a plurality of teeth formed in a linear configuration, said teeth being coupled to said receiver portion, said extension member of each of said extension assemblies comprising at least one pawl, said pawl of said extension member being selectively positionable in a position between two selected teeth of said plurality of teeth of said base member of the associated one of said extension assemblies to inhibit inadvertent sliding of said extension member with respect to said base portion of the associated one of said extension assemblies.

2. The hanger apparatus as set forth in claim 1, further comprising:

each of said arm members comprising an upper portion and a lower portion, said upper portion being coupled to said lower portion such that said upper portion extends outwardly from said lower portion, said guide portion of said extension member extending around said upper portion of the associated one of said arm members to inhibit said extension member from inadvertently disengaging the associated one of said arm members when said extension member is slid along the associated one of said arm members.

3. The hanger apparatus as set forth in claim 1, wherein each arm member has an outboard end, and wherein at least one of said pair of extension assemblies is adjustable to a position in which said extension assembly does not extend beyond the outboard end of said arm member.

4. A hanger apparatus for adjusting to accommodate garments of different sizes, the hanger apparatus comprising:

a hook member being adapted for selectively engaging a hanging member such that said hook member is suspended from the banging member;

a pair of arm members being coupled to said hook member such that said arm members are suspended from the banging member when said hook member engages the hanging member, said arm members being adapted for being positioned in one of the garments to allow the garment to be suspended from the hanging member; and each of a pair of extension assemblies engaging one of said arm members such that each of said extension assemblies selectively extends beyond the associated one of said arm members to accommodate garments of a larger size;

wherein a first one of said pair of extension assemblies is adjustable on said pair of arm members independently of a second one of said pair of extension assemblies;

wherein each of said extension assemblies comprises a base member and an extension member, said base member being mounted on the associated one of said arm members, said extension member being movable with respect to said base member and being slidable on the associated one of said arm members such that said extension member is selectively positionable along a length of the associated one of said arm members for supporting garments of a larger size;

wherein said extension member of each of said extension assemblies comprises a support portion and a guide portion, said support portion being coupled to said guide portion such that said support portion extends upwardly from said guide portion, said guide portion slidably engaging the associated one of said arm members such that said guide portion is selectively slidable along a length of the associated one of said arm members to allow adjustment of the extension member to accommodate garments;

wherein each of said arm members comprises an upper portion and a lower portion, said upper portion being coupled to said lower portion such that said upper portion extends outwardly from said lower portion, said guide portion of said extension member extending around said upper portion of the associated one of said arm members to inhibit said extension member from inadvertently disengaging the associated one of said arm members when said extension member is slid along the associated one of said arm members;

wherein said base member of each of said extension assemblies comprises a stanchion portion and a receiver portion, said stanchion portion being coupled to the associated one of said arm members, said receiver portion being coupled to said stanchion portion such that said receiver portion is positioned opposite the associated one of said arm members, said receiver portion slidably receiving said support portion of said extension member of the associated one of said extension assemblies, said receiver portion being for maintaining alignment of said extension member with the associated one of said arm members when said extension member is slid along the associated one of said arm members;

wherein said base member of each of said extension assemblies comprises a plurality of teeth formed in a linear configuration, said teeth being coupled to said receiver portion, said extension member of each of said extension assemblies comprising at least one pawl, said pawl of said extension member being selectively positionable in a position between two selected teeth of said plurality of teeth of said base member of the associated one of said extension assemblies to inhibit inadvertent sliding of said extension member with respect to said base portion of the associated one of said extension assemblies; and wherein each arm member has an outboard end, and wherein at least one of said pair of extension assemblies is adjustable to a position in which said extension assembly does not extend beyond the outboard end of said arm member.

* * * * *